US007144088B2

(12) United States Patent
Chang

(10) Patent No.: US 7,144,088 B2
(45) Date of Patent: Dec. 5, 2006

(54) METHOD OF MANUFACTURING MESS SPONGES

(76) Inventor: Jone Chang, 4F., No. 57, Minhe St., Wanhua District, Taipei City (TW)

( * ) Notice: Subject to any disclaimer, the term of this patent is extended or adjusted under 35 U.S.C. 154(b) by 396 days.

(21) Appl. No.: 10/840,356

(22) Filed: May 7, 2004

(65) Prior Publication Data

US 2005/0248210 A1 Nov. 10, 2005

(51) Int. Cl.
*A47K 7/02* (2006.01)

(52) U.S. Cl. ..... 300/21; 15/209.1

(58) Field of Classification Search ..... 300/21; 15/209.1, 229.11

See application file for complete search history.

(56) References Cited

U.S. PATENT DOCUMENTS

| | | | | |
|---|---|---|---|---|
| 5,727,278 | A * | 3/1998 | Per-Lee | 15/229.11 |
| 6,439,144 | B1 * | 8/2002 | Chen | 112/475.06 |
| 2002/0152571 | A1 * | 10/2002 | Lee | 15/209.1 |

FOREIGN PATENT DOCUMENTS

| | | | |
|---|---|---|---|
| JP | 10-192188 | * | 7/1998 |
| TW | 423302 | | 2/2001 |
| TW | 491070 | | 6/2002 |
| TW | 502612 | | 9/2002 |

* cited by examiner

*Primary Examiner*—Mark Spisich
(74) *Attorney, Agent, or Firm*—Birch, Stewart, Kolasch & Birch, LLP

(57) ABSTRACT

The present invention discloses a method of manufacturing mess sponges comprised of a sponge made of soft films of a PVA material by repeatedly folding into a flower-shaped structure having a plurality of pedals. Since the sponge has a high density and adhesiveness for the soap and a powerful rubbing and scrubbing effect, which can be used for scrubbing a dirtier position of our body. The flower-shaped structure can also clean the smoother and softer parts of our body, and thus can greatly enhance the convenience of scrubbing human body, since the flower-shaped structure has a plurality of pedals. The present invention not only has a better appearance than other shower scrubbing tools, but also provides a more convenient way for its use.

4 Claims, 5 Drawing Sheets

METHOD OF MANUFACTURING MESS SPONGES

FIELD OF THE INVENTION

The present invention relates to a method of manufacturing mess sponges, more particularly to a method of manufacturing mess sponges by repeatedly folding into a flower-shaped sponge with a plurality of pedals.

BACKGROUND OF THE INVENTION

In the structure of a conventional bath mess sponge as shown in the R.O.C. Patent Publication No. 423302 entitled "Bath towel structure" disclosed a mess sponge structure made by stacking one or more mesh layers of equal and appropriate length together, which is very thin and not dense enough and thus resulting in a very weak capability of adhering soap.

Further, the conventional mess sponge is formed by wrapping a mesh bath towel into a spherical shape, but its capability of adhering soap is still not high enough. The whole structure is loose and thus resulting in an insufficient rubbing force because the structure is twisted excessively when being used for rubbing a dirtier body. It is necessary to compress the sponge densely, laboriously, and inconveniently to improve the rubbing force of the sponge. Furthermore, the combination of its stylish appearances is limited and not artistic.

In view of the foregoing mesh structures having a capability of adhering soap according to the R.O.C. Patent Publication No. 491070 entitled "Bath sponge structure" and the R.O.C. Patent Publication No. 502612 entitled "Bath sponge structure" are made of a soft PE film material with a very strong capability of adhering soap. However, the manufacturing process for binding the prior-art bath sponge requires lots of labors and processes, which will be a burden to the cost. In view of such shortcoming, the present invention gives a method of manufacturing mesh sponges by adopting a soft PVA film material, not only simplifying the binding process, but also improving its artistic appearance.

SUMMARY OF THE INVENTION

The primary objective of the present invention is to overcome the foregoing shortcoming and avoid the exiting deficiency. The present invention provides a method of manufacturing mess sponges by repeatedly folding a sheet sponge inward into a flower-shaped structure having a plurality of pedals.

The secondary objective of the present invention is to provide a mess sponge structure which can be used to rub a dirtier body and cleaning a smoother part of the body due to its high density, good capability of adhering soap and strong rubbing force.

The mess sponge structure according to the invention comprises: at least one sponge, being made of a soft PVA material in the shape of a long bar and with a continuous wavy external look; and a rope, being made of a nylon material.

The method of manufacturing mess sponges according to the invention combines the foregoing two elements by repeatedly folding them into a flower-shaped structure, comprising the steps of:

(1) coiling and folding a first wavy pedal along an external periphery of the continuous wavy pedal of the sponge and then coiling and folding a second wavy pedal in an opposite direction with a distance from the first wavy pedal, wherein a central section is defined at a position where the second folding in opposite direction is taken place (2) repeating the foregoing step (1) according to the length of the sponge to fold and press the central section at a distance from the second wavy pedal;

(3) using a binder to wind the central section after completing step (2), and rearranging a wrinkle produced when winding the binder in order to keep the binder in a loose condition and then passing an end of the rope through the binder, and tying the other end into a knot and pressing the knot against the central section, and then pressing the binder against the central section to constitute a configuration having a plurality of pedals;

(4) arranging the plurality of pedals near the central section, and cutting off a section remained after tying the binder as shown in step (3) to form a complete flower shape.

DETAILED DESCRIPTION OF THE PREFERRED EMBODIMENTS

To make it easier for our examiner to understand the objective of the invention, its structure, innovative features, and performance, we use a preferred embodiment and the attached drawings for the detailed description of the invention.

Figure 1A:
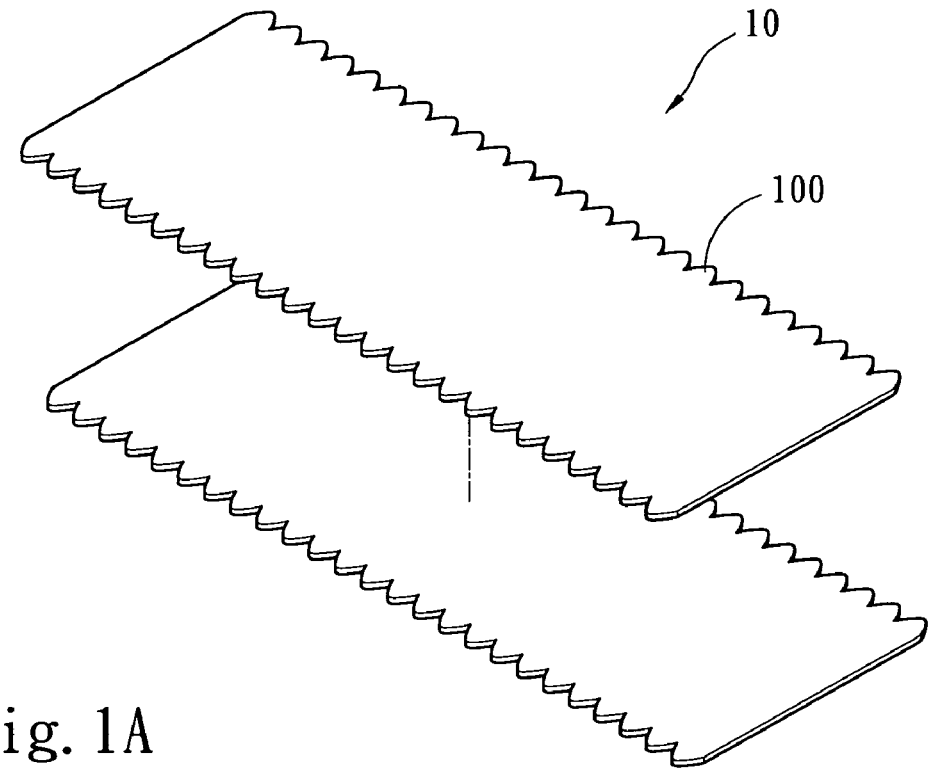
FIGS. 1A~1G are the views for the steps of manufacturing mess sponge according to the present invention.
Figure 1B:
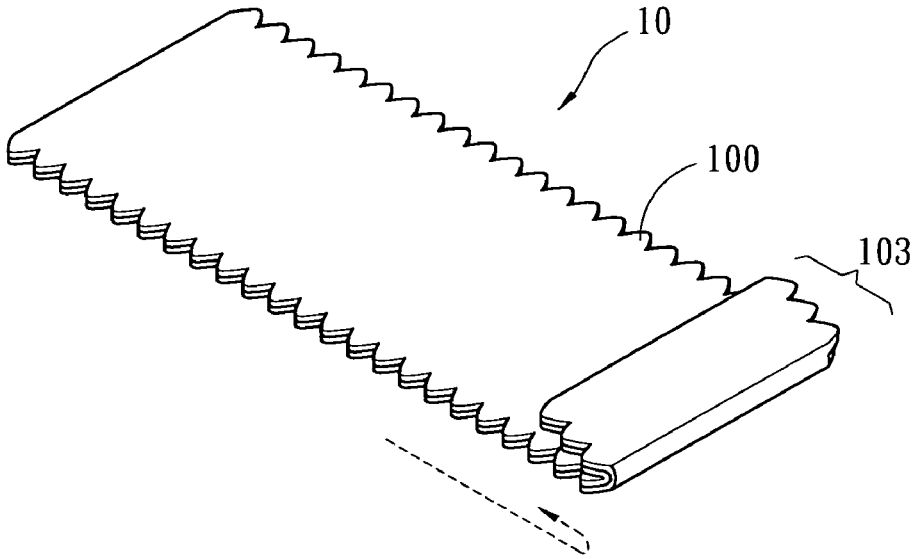
Figure 1C:
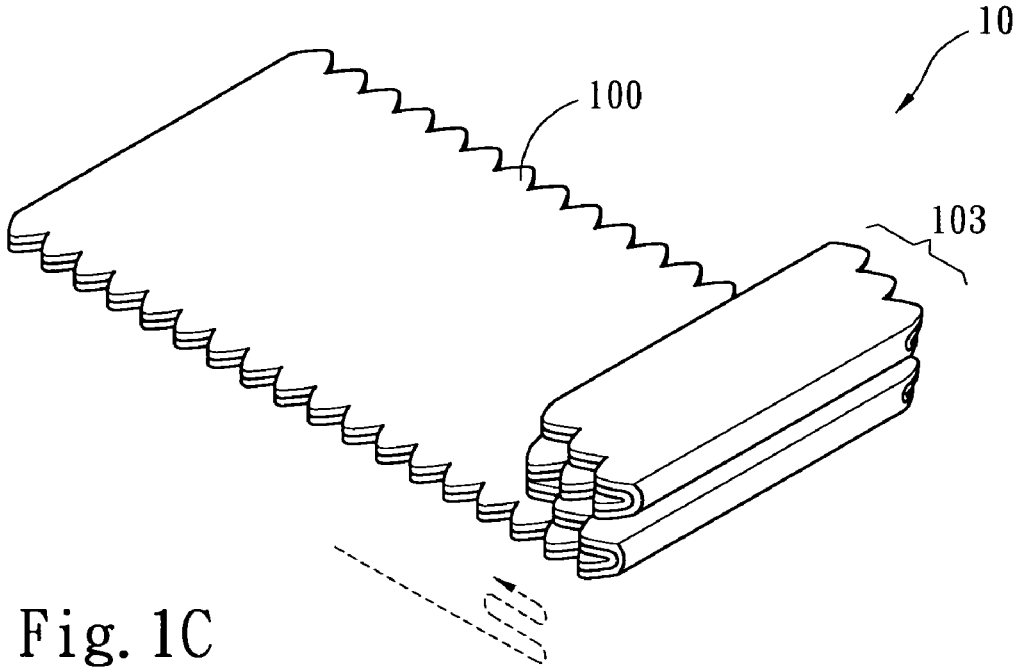
Figure 1D:
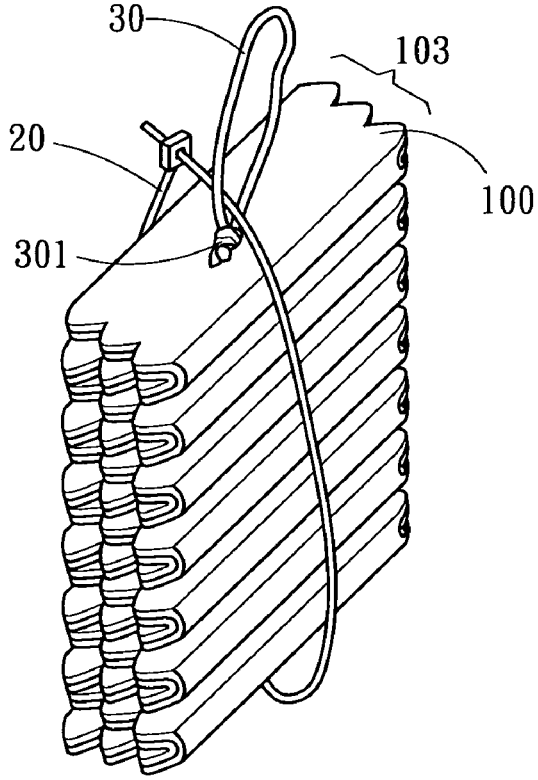
Figure 1E:
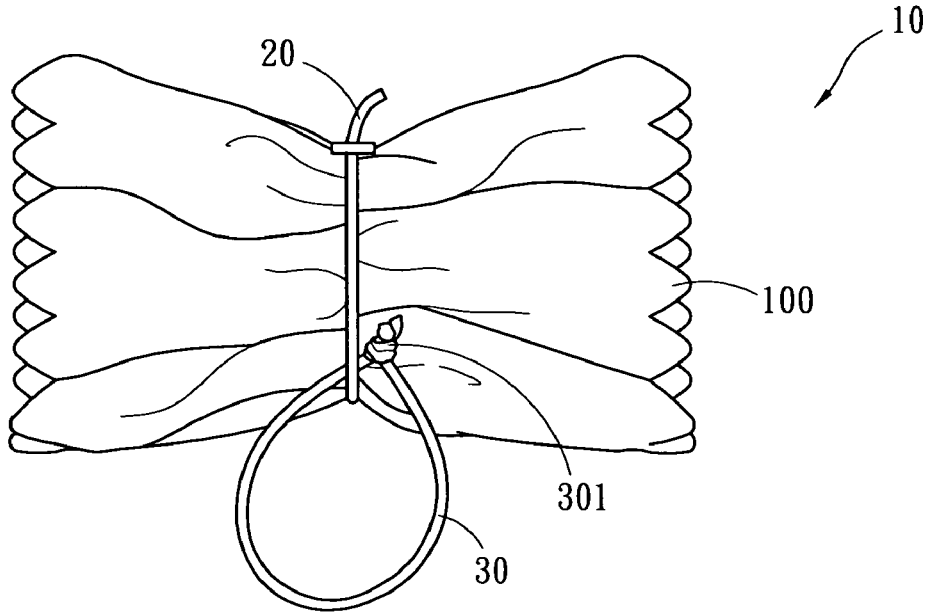
Figure 1F:
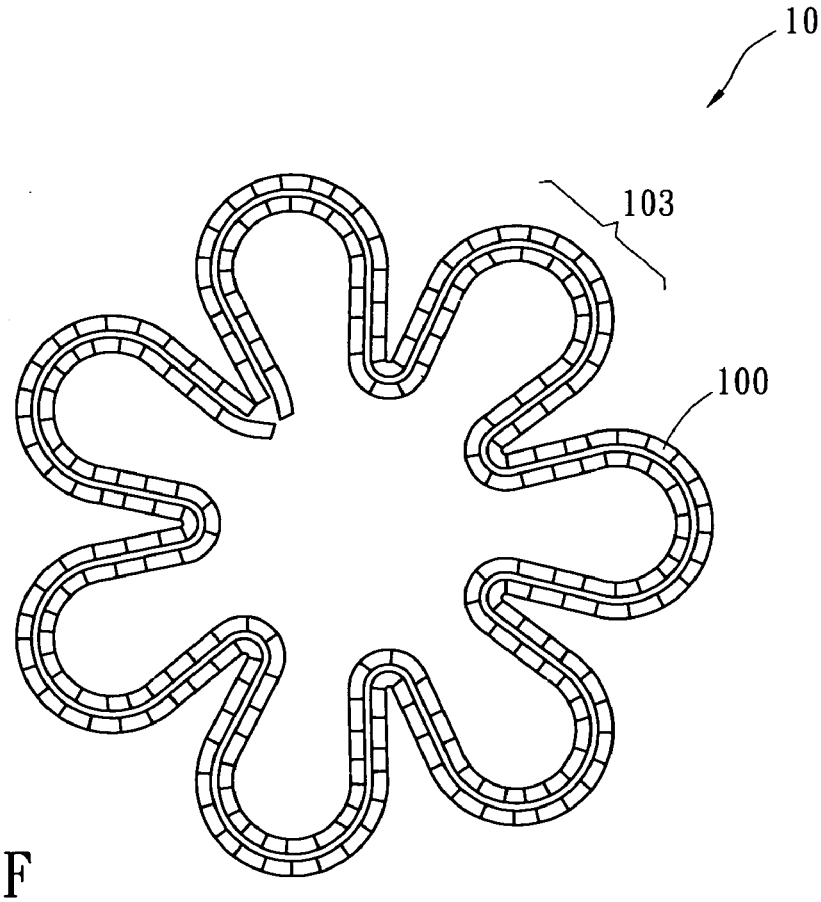
Figure 1G:
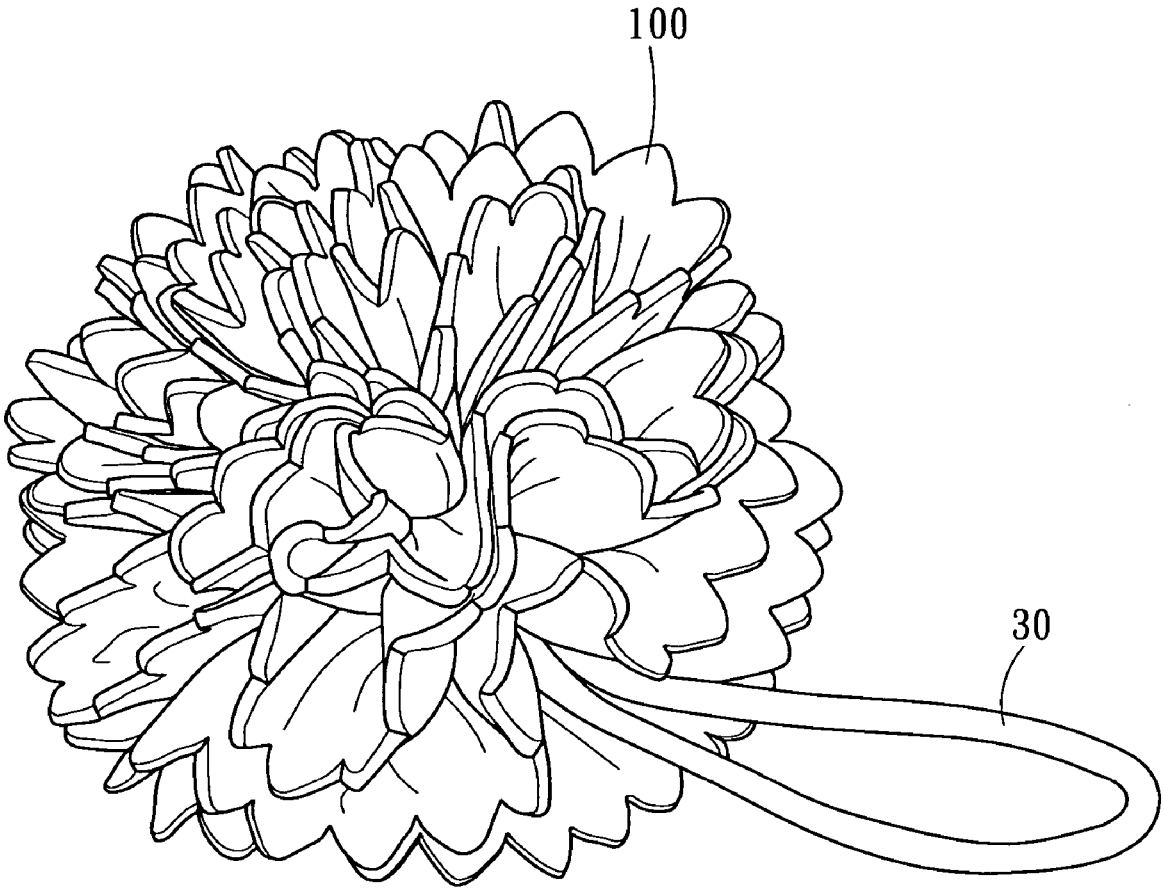
Figure 2:
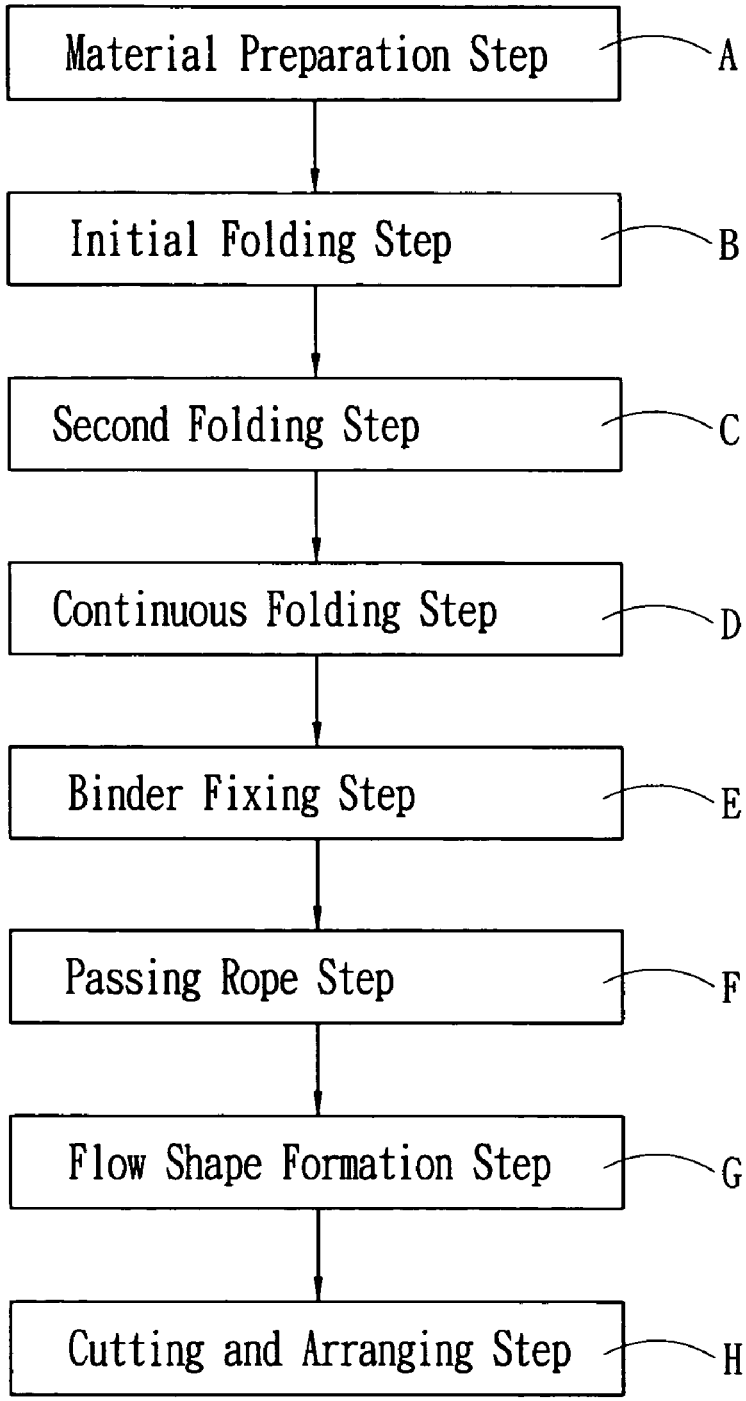
FIG. 2 is a flow chart of the present invention.

Please refer to FIGS. 1A, 1D, and 1G for a mess sponge structure according to the present invention, which uses a folding method to repeatedly folding a sponge 10 to form a flower-shaped structure having a plurality of wavy pedals 100, and comprises:

a long bar-shaped sponge 10, being made of a soft PVA material and having an external appearance with the lines of irregular continuous wavy pedals 100, and the sponge 10 could be a single sheet or overlapped by a multiple of sheets, and a flower-shaped structure having a plurality of pedals formed by repeatedly folding two sheets of sponges inward according to this embodiment as shown in FIG. 1G; and a rope 30, using a binder 20 for fixing and winding the sponge 10 and an end of the rope 30 passing through the binder 20 and the other end being tied into a knot 301 to tightly press against a central section 103 as shown in FIG. 1D, and then the binder 20 tightly tie the central section 103 to constitute a flower-shaped mess sponge structure having a plurality of wavy pedals 100 as shown in FIG. 1G.

Please refer to FIGS. 1A~1G and 2 for the views of the procedure and the flow chart of producing the mess sponge according to the present invention. The method of manufacturing mess sponges according to the invention comprises the steps of:

(a) Material Preparation Step: preparing two sheets of a long-bar shaped sponge 10 having continuous wavy pedals 100 at its external periphery as shown in FIG. 1A;

(b) Initial Folding Step: coiling and folding a first wavy pedal 100 along an external periphery of the continuous wavy pedal of the sponge 10 according to the distance from the first wavy pedal and the direction as indicated by the arrows in FIG. 1B;

(c) Second Folding Step: coiling and folding a second wavy pedal 100 in an opposite direction as indicated by the arrow in FIG. 1C along the external periphery of the continuous wavy pedal according to the distance of the second wavy pedal 100, wherein the distance from the second wavy pedal 100 is larger than that from the first wavy pedal 100, and a central section 103 is defined at the position where the folding in an opposite direction takes place as shown in FIG. 1C;

(d) Continuous Folding Step: repeating step (c) and continuing to fold according to the distance of the second wavy pedal 100 to tightly press against the central section 103 (preferably repeating step (d) for six times for folding the pedals, so that the folded wavy pedals 100 will not be loosened so easily as shown in FIG. 1D;

(e) Binder Fixing Step: using a binder 20 to wind the central section 103 after completing step (d). At that time, the binder 20 is not wound tightly around the central section 103 but still has some buffer spaces to facilitate rearranging a wrinkle produced during winding the binder 20 and form a complete flower-shaped structure;

(f) Passing Rope Step: passing an end of a rope 30 through the binder 20, and the other end of the rope 30 being tied into a knot 301 and the knot 301 pressing against the central section 103 as shown in FIG. 1E, and then the binder 20 is tied tightly to constitute the configuration with a plurality of pedals (preferably a configuration having 7 pedals by folding 7 layers of pedals at the central section 103);

(g) Flow Shape Formation Step: arranging the plurality of wavy pedals 100 near the central section 103, and folding the remaining pedals 100 outward to form a spiral member and constitute a flower-shaped appearance having a plurality of wavy pedals 100 as shown in FIG. 1G; and (h) Cutting and Arranging Step: cutting off the section remained after tying the binder as described in Step (e).

In summation of the description above, the method for manufacturing mess sponges according to the invention repeatedly folds sheets of sponges 10 into a flower-shaped structure having a plurality of pedals 100, and the sponge 10 can be used to rub a dirtier position of the body due to its higher density for adhering soap and stronger rubbing force, and the flower-shaped structure so produced can clean softer parts of the body, and thus greatly improving the convenience of rubbing our bodies.

What is claimed is:

1. A method of manufacturing mess sponges, comprising the steps of:

(a) preparing a long-bar shaped sponge having continuous wavy pedals;

(b) coiling and folding a first wavy pedal along an external periphery of said continuous wavy pedal of said sponge;

(c) coiling and folding a second wavy pedal in an opposite direction with a distance from said first wavy pedal, wherein the distance from said second wavy pedal being larger than that from said first wavy pedal, and said two coiling and folding processes defining a central section;

(d) repeating step (c) according to the length of said sponge to fold and press said central section with a distance from said second wavy pedal;

(e) using a binder to wind said central section after completing step (d), and arranging a wrinkle produced during winding said binder to keep said binder in a loose condition;

(f) passing an end of a rope through said binder, and the other end being tied into a knot and pressing said knot against said central section, and then pressing said binder against said central section to constitute a configuration having a plurality of pedals;

(g) arranging said plurality of pedals near said central section, and folding a pedal disposed within said pedals outward to form a spiral member, and said remaining pedals being separated; and (h) cutting off a section remained after tying said binder to form a complete flower shape.

2. The method of manufacturing mess sponges of claim 1, wherein said sponge described in step (a) is a sheet sponge.

3. The method of manufacturing mess sponges of claim 1, wherein said sponge described in step (a) is formed by overlapping a plurality of sheet sponges.

4. The method of manufacturing mess sponges of claim 1, wherein said sponge is made of a soft PVA material.

* * * * *